United States Patent [19]

Pierce

[11] 4,154,633

[45] May 15, 1979

[54] METHOD FOR MAKING SOLID PROPELLANT COMPOSITIONS HAVING A SOLUBLE OXIDIZER

[75] Inventor: Everette M. Pierce, Somerville, Ala.

[73] Assignee: The United States of America as represented by the Secretary of the Army, Washington, D.C.

[21] Appl. No.: 896,271

[22] Filed: Apr. 14, 1978

[51] Int. Cl.[2] ..... C06B 45/10

[52] U.S. Cl. ..... 149/19.92; 149/19.1; 149/19.4; 149/19.8; 149/19.9; 149/45; 149/75; 149/88; 149/119

[58] Field of Search ..... 149/19.1, 119, 19.4, 149/45, 19.8, 19.9, 19.92, 75, 88

[56] References Cited

U.S. PATENT DOCUMENTS

| | | | |
|---|---|---|---|
| 3,148,229 | 9/1964 | Bordenkircher et al. | 149/19.92 |
| 3,296,043 | 1/1967 | Fluke et al. | 149/19.4 |
| 3,531,338 | 9/1970 | Byrne | 149/19.4 |
| 3,567,530 | 3/1971 | Lait et al. | 149/19.4 |
| 3,779,822 | 12/1973 | Stammler et al. | 149/75 |
| 3,926,696 | 12/1975 | Klunsch et al. | 149/88 |
| 3,976,522 | 8/1976 | Rothenstein | 149/75 |

*Primary Examiner*—Edward A. Miller

*Attorney, Agent, or Firm*—Nathan Edelberg; Robert P. Gibson; Jack W. Voigt

[57] ABSTRACT

An oxidizer that is soluble in a polar solvent selected from ethanol, diethyl ether, and acetone is used in a propellant composition mixing procedure to effect an improved dispersion of the oxidizer. The soluble oxidizer is selected from the reaction products formed by reacting together an equivalent amount of a first reactant selected from triethanol amine or diethanol amine with an equivalent amount of a second reactant perchloric acid when the soluble perchlorate salt is desired for use. The soluble oxidizer is selected from the reaction products formed by reacting together an equivalent amount of a first reactant selected from triethanol amine or diethanol amine with an equivalent amount of a second reactant nitric acid when the soluble nitrate salt is desired for use. The dissolved oxidizer is added to the binder portion of the propellant during mixing. After being widely dispersed, the soluble oxidizer and binder portion are mixed under low vacuum and mild heat (e.g., 110° F. to 120° F.) to remove the polar solvent thereby leaving the oxidizer in a widely dispersed state. The other propellant ingredients are added and mixing is continued to achieve homogenity prior to forming and curing the propellant for its intended use. The propellant composition with the widely dispersed oxidizer shows improved burning rate.

5 Claims, No Drawings

METHOD FOR MAKING SOLID PROPELLANT COMPOSITIONS HAVING A SOLUBLE OXIDIZER

DEDICATORY CLAUSE

The invention described herein may be manufactured, used, and licensed by or for the Government for governmental purposes without the payment to me of any royalties thereon.

BACKGROUND OF THE INVENTION

The burning rates of solid propellant compositions have been the subject of much research and development work. These research and development works have demonstrated in the field of solid propellants that the burning rates of solid propellant compositions are higher as the particle size of the oxidizer is decreased, especially for the ammonium perchlorate oxidized systems. This relationship of burning rate to particle size of oxidizer has been demonstrated in all the binder systems used (double-base, polyurethanes, polyesters, rubbers, etc.).

To achieve a reduction of ammonium perchlorate (AP) particle size to the ultra-fine state (e.g. less than 2.5 micron average particle size) and to the ultra-ultra-fine state (e.g. less than 0.5 micron average particle size) special grinding aids have been developed for the function of preventing agglomeration of the extremely fine AP during grinding and in propellant mixing procedures. Other problems have been associated with using ultra-ultra-fine AP. One problem has been maintaining consistency of burning rate in propellants where the AP has been from different production batches. Also, the cost increase of ultra-ultra-fine AP and the resulting cost increase of the propellant composition is significant due to increased power requirements due to grinding and mixing. The pot life of ultra-ultra-fine AP oxidized propellants is shortened without the use of pot life extenders such as aziridine compounds (e.g. N-phenethylaziridine and other selected alkyl diaziridine compounds). The problems associated with loss of pot life have resulted not only in increased cost but in variable quality and performance for the finished propellant grain.

An object of this invention is to provide a propellant composition with improved burning rate as a result of an improved method of dispersing the oxidizer for the propellant composition.

Another object of this invention is to provide a soluble oxidizer for employment in a propellant mixing procedure which results in an intimate dispersion of the oxidizer in the finished propellant composition.

SUMMARY OF THE INVENTION

An oxidizer that is soluble in a polar solvent is used in a solid propellant composition mixing procedure to effect wide dispersion of the oxidizer. The oxidizer in the polar solvent is added to the binder portion of the propellant during mixing. After being widely dispersed, the soluble oxidizer and binder are mixed under low vacuum and mild heat (e.g. 110° F. to 120° F.)to remove the polar solvent thereby leaving the oxidizer in a widely dispersed state. The other propellant ingredients are added and mixing is continued to achieve homogenity prior to forming and curing the propellant for its intended use.

The oxidizer is selected from the triethanol or diethanol amine reaction products formed from reacting the specified amines with nitric acid or perchloric acid. The reaction products are prepared by reacting equivalent amounts of the reactants. The reaction products of triethanol amine and perchloric acid are polytriethanol amine perchlorates with an average molecular weight of about 600. Other reaction products are polyethanol amine perchlorates or polyethanol amine nitrates with molecular weights of up to about 600. The reaction products are dissolved in an appropriate amount of a polar solvent which can be easily removed under low vacuum and mild heat as specified. The preferred polar solvent is selected from ethanol, diethyl ether, and acetone. The polar solvent, water, is not preferred for use alone; however, it can be used in combination with the polar solvent ethanol. In actuality, ethanol contains about 5% water. If a combination containing water is used, processing will require more controls. For example, the water in combination with isocyanate curable compositions should be processed in accordance with established procedures to avoid gassing in the finished propellant grain; otherwise, propellant grains with voids and cracks could result.

DESCRIPTION OF THE PREFERRED EMBODIMENT

The soluble oxidizers of this invention which are widely dispersed in a solid propellant composition yield higher burning rates for the composition as compared to an equivalent amount of oxidizer added as a solid material. The soluble oxidizer employed is selected from the group of reaction products formed from reacting the equivalent amounts of triethanol or diethanol amine with nitric acid when the desired oxidizer is a nitrate or from the group of reaction products formed from reacting the equivalent amounts of triethanol or diethanol amine with perchloric acid when the desired oxidizer is a perchlorate.

The method of this invention incorporates the oxidizer (wholly or in part) as a liquid or in solution. The oxidizer is dissolved in the predetermined amount of a polar solvent selected from the group consisting of ethanol, diethyl ether, or acetone to achieve a solution. The dissolved oxidizer is added to the binder portion of the propellant during mixing. After a homogenic mixture is obtained, the soluble oxidizer and binder portion are mixed under low vacuum and mild heat (e.g., 110° F. to 120° F.) to remove the polar solvent thereby leaving the oxidizer in a widely dispersed state. The remaining propellant ingredients are added and mixing is continued to achieve homogenity prior to forming and curing the propellant for its intended use.

Small mixes of double-base compositions employing cyclotetramethylenetetranitramine (HMX) as added oxidizer were prepared as control samples. Test samples using the soluble oxidizer (polytriethanol amine perchlorate) substituted for HMX at the 20% level demonstrated over a 100% increase in burning rate.

The soluble oxidizer as employed in this invention to achieve intimate dispersement of the oxidizer after solvent removal can be employed with all binder systems used. The propellant compositions in addition to the binder portion which can be nitrocellulose, polyurethane, polyester, rubber type binders (of which the polybutadiene binders are respresentative), and polysulfide binders would include plasticizers, metal fuel, stabilizers, and crosslinkers.

Additional test samples were made using rubber base (hydroxyl-terminated polybutadiene) binders wherein a substitution at the 20% level of soluble oxidizer was made for the solid AP. Over 100% increase in burn rate was achieved. An increase in burn rate is noted by using from as little as 5% and up to 50% of a soluble oxidizer.

The mixing is continued under low vacuum and mild heat until the polar solvent used to get the oxidizer in solution is removed. This procedure is essential to prevent gassing during curing stage especially where an isocyanate cure is employed. Due to presence of trace amounts of water which is also removed, but with difficulty prior to curing, isophorone diisocyanate works well in the compositions employing soluble oxidizer because it is not as sensitive to water as other isocyanates.

The solid propellant compositions which can employ a selected soluble oxidizer of this invention contain a binder portion from about 5 to about 25 weight percent, a soluble oxidizer as defined hereinabove from about 5 to about 50 weight percent, and the remaining solid propellant ingredients in a combined amount from about 25 to about 90 weight percent. The remaining solid propellant ingredients comprise optional solid oxidizer salts such as ammonium perchlorate, ammonium nitrate, potassium perchlorate, nitronium perchlorate, cyclotetramethylenetetranitramine (HMX), and cyclotrimethylenetrinitramine (RDX); optional metal fuels such as aluminum, zirconium, boron, beryllium, and magnesium; plasticizers of the energetic types such as nitroglycerin, butane trioltrinitrate, diethylene glycol dinitrate, triethylene glycol dinitrate, trimethylol trinitrate, and tetraethylene glycol dinitrate; plasticizers of the inert types such as triacetin, diethyl phthalate, propyl adipate, and dibutyl sebacate; stabilizer as used to stabilize nitrocellulose and nitrate ester plasticizers during cure and storage (e.g., resorcinol and 2-nitrodiphenylamine); crosslinkers such as toluene diiocyanate, hexamethylene diisocyanate, and isophorone diisocyanate for hydroxyl terminal binder ingredients or crosslinkers such as diepoxide, diaziridine, or triaziridine crosslinking and curing agents for carboxyl terminal binder ingredients; and selected additives, ballistic agents, and processing aids for desired processing parameters and the finished propellant properties.

The formulating, mixing, and processing of the many types of formulations with which the soluble oxidizers of this invention are usable are well established in the art. The guidelines provided herein are illustrative of how to employ the soluble oxidizers of this invention in a method to achieve improved dispersion of the oxidizer and a corresponding increase in the burning rate of the solid propellant composition. Thus, the solid propellant composition which can be improved by enhanced burning rate achieved as a result of improved oxidizer dispersion include three compatible basic portions. These three compatible basic portions of a solid propellant composition include: the binder portion, the oxidizer portion (which can be wholly or in part the liquid oxidizers of this invention), and the fuel portion, the fuel portion generally includes metals in a finely divided state and combustible solids of the solid propellant composition. Other remaining propellant ingredients of the solid propellant composition having established contributions for the functions performed can be included in the basic composition or can be included as additives. These remaining propellant ingredients are employed for their contributions which relate to processing parameters, mechanical properties enhancement, stability, ballistic properties enhancement, and special burning rates as required for the parameters of operation for the solid propellant compositions.

I claim:

1. A method for preparing a solid propellant composition to achieve an improved dispersion of the oxidizer which contributes to increased burning rate of said composition, said method comprising:

(i) adding a solid propellant binder portion of a solid propellant composition to a mixer adapted with vacuum means and heating means, said binder portion selected from the binder formulation groups consisting of nitrocellulose binder, polyester binder, polyurethane binder, polybutadiene binder, and polysulfide binder;

(ii) mixing with said solid propellant binder portion a soluble oxidizer selected from thhe reaction product formed by reacting together an equivalent amount of a first reactant selected from the group consisting of diethanol amine and triethanol amine with an equivalent amount of a second reactant selected from the group consisting of perchloric acid and nitric acid, said soluble oxidizer being dissolved in a polar solvent selected from the group consisting of ethanol, diethyl ether and acetone prior to said mixing with said solid propellant binder portion;

(iii) continuing said mixing to achieve a homogenic mixture of said solid propellant binder portion and said soluble oxidizer;

(iv) applying a low vacuum and mild heat to said mixer containing said homogenic mixture and continuing mixing to remove said polar solvent thereby leaving said oxidizer in a widely dispersed state;

(v) releasing vacuum and adding any remaining propellant ingredients of said solid propellant composition;

(vi) continuing the mixing under vacuum conditions said solid propellant composition containing all the propellant ingredients to again achieve homogenity; and, (vii) adding curing agent for said solid propellant composition and continuing mixing under vacuum to effect dispersion of curing agent prior to forming and curing said solid propellant composition.

2. The method of claim 1 wherein said soluble oxidizer selected is the reaction product formed by reacting an equivalent amount of triethanol amine with an equivalent amount of perchloric acid, and wherein said binder portion selected is polybutadiene binder.

3. The method of claim 1 wherein said soluble oxidizer selected is the reaction product formed by reacting an equivalent amount of triethanol amine with an equivalent amount of perchloric acid, said selected polar solvent is acetone, and wherein said binder portion selected is nitrocellulose binder.

4. The method of claim 1 wherein said soluble oxidizer selected is the reaction product formed by reacting an equivalent amount of triethanol amine with an equivalent amount of perchloric acid, said selected polar solvent is acetone, and wherein said binder portion selected is polyurethane binder.

5. The method of claim 1 wherein said soluble oxidizer selected is the reaction product formed by reacting an equivalent amount of triethanol amine with an equivalent amount of perchloric acid, said selected polar solvent is acetone, and wherein said binder portion selected is polysulfide binder.

* * * * *